US009291922B2

(12) United States Patent
Murakami et al.

(10) Patent No.: US 9,291,922 B2
(45) Date of Patent: Mar. 22, 2016

(54) METHOD FOR PRODUCING ELECTROPHOTOGRAPHIC PHOTOSENSITIVE MEMBER

(71) Applicant: CANON KABUSHIKI KAISHA, Tokyo (JP)

(72) Inventors: Mai Murakami, Kashiwa (JP); Yuka Ishiduka, Suntou-gun (JP); Wataru Kitamura, Matsudo (JP); Masaki Nonaka, Toride (JP); Ryoichi Tokimitsu, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 32 days.

(21) Appl. No.: 14/229,505

(22) Filed: Mar. 28, 2014

(65) Prior Publication Data

US 2014/0295344 A1 Oct. 2, 2014

(30) Foreign Application Priority Data

Apr. 1, 2013 (JP) ..... 2013-076490

(51) Int. Cl.

| | |
|---|---|
| ***G03G 15/04*** | (2006.01) |
| ***G03G 5/05*** | (2006.01) |
| ***G03G 5/14*** | (2006.01) |

(52) U.S. Cl.

CPC ..... *G03G 5/0525* (2013.01); *G03G 5/0517* (2013.01); *G03G 5/142* (2013.01); *G03G 5/144* (2013.01)

(58) Field of Classification Search

CPC .. G03G 5/0525; G03G 5/0517; G03G 5/0601
USPC ..... 430/60, 63, 131
See application file for complete search history.

(56) References Cited

U.S. PATENT DOCUMENTS

| | | | | |
|---|---|---|---|---|
| 2003/0181634 | A1 * | 9/2003 | Kitano et al. | 528/482 |
| 2009/0035674 | A1 * | 2/2009 | Wu | 430/58.8 |

FOREIGN PATENT DOCUMENTS

| | | | |
|---|---|---|---|
| JP | 5817450 | A | 2/1983 |
| JP | 2006221094 | A | 8/2006 |

* cited by examiner

*Primary Examiner* — Thorl Chea
(74) *Attorney, Agent, or Firm* — Canon USA Inc. IP Division

(57) ABSTRACT

A composition that contains a compound represented by the formula (1) is dissolved in an organic compound, and the composition is purified by using a basic adsorbent that contains at least 15% by mass magnesium and has a volume average particle diameter of 10 μm to 500 μm, both inclusive. An undercoat-layer-forming coating liquid is prepared by removing the basic adsorbent and dispersing metal oxide particles in the obtained solution containing the purified form of the composition. An undercoat layer is formed by forming a coat of the undercoat-layer-forming coating liquid and drying the coat.

7 Claims, No Drawings

METHOD FOR PRODUCING ELECTROPHOTOGRAPHIC PHOTOSENSITIVE MEMBER

BACKGROUND OF THE INVENTION

1. Field of the Invention

The present invention relates to a method for producing an electrophotographic photosensitive member.

2. Description of the Related Art

Organic electrophotographic photosensitive members (hereinafter referred to as "electrophotographic photosensitive members") have been increasingly used in the market as copiers and laser-beam printers have been spreading in recent years. An electrophotographic photosensitive member used in such equipment has an undercoat layer that contains metal oxide particles and a photosensitive layer on the undercoat layer.

The undercoat layer may contain an organic compound for some purposes such as stabilizing electrical properties and reducing failures in image quality. Japanese Patent Laid-Open No. 2006-221094 discloses a technology in which an undercoat layer contains an acceptor compound, such as an anthraquinone compound, in addition to metal oxide particles. The publication states that the acceptor compound preferably contains, in particular, a group that reacts with the metal oxide particles, adding that providing the undercoat layer with electron acceptability reduces ghosting.

On the other hand, Japanese Patent Laid-Open No. 58-017450 discloses a technology in which an undercoat layer contains a benzophenone compound, a known ultraviolet absorber. This technology reduces the damage to a charge transport material associated with ultraviolet radiation, thereby reducing the decline in electrical properties that occurs with repeated use of the electrophotographic photosensitive member.

Some of such organic compounds having a group that reacts with metal oxide particles, however, become more likely to absorb light from a semiconductor laser used as a light source upon interaction with the metal oxide particles. The oscillation wavelength of semiconductor lasers that are now commonly used as a light source ranges from 650 to 820 nm. When the reflectivity of the surface of the undercoat layer is low with respect to laser light in this wavelength range, the sensitivity of the electrophotographic photosensitive member may also be low.

It is therefore preferred to use a compound that remains unlikely to absorb light in the above wavelength range upon interaction with metal oxide particles. Even such a compound, however, can contain a colored impurity in addition to the main ingredient, depending on the process used to synthesize the compound. Such an impurity can reduce the reflectivity of the undercoat layer with respect to laser light and affect sensitivity as in the above case.

SUMMARY OF THE INVENTION

As can be seen from the above, it is needed to improve the decline in the sensitivity of an electrophotographic photosensitive member due to a colored impurity that occurs when the undercoat layer of the photosensitive member contains metal oxide particles and an organic compound. An aspect of the invention, made in light of this problem, is intended to provide a method for producing an electrophotographic photosensitive member that allows for efficient removal of a colored impurity from a particular organic compound used in an undercoat layer and provides the photosensitive member with good sensitivity characteristics.

The inventors found through research that an electrophotographic photosensitive member having an undercoat layer that contains metal oxide particles and a benzophenone compound represented by the formula (1) and purified by a particular process has better sensitivity characteristics than in the case where the benzophenone compound is used without purification.

An aspect of the invention therefore relates to a method for producing an electrophotographic photosensitive member that has a support, an undercoat layer on the support, and a photosensitive layer on the undercoat layer. The method includes:

(i) dissolving a composition that contains a compound represented by the formula (1) in an organic solvent and purifying the composition by using a basic adsorbent;

(ii) after (i), preparing an undercoat-layer-forming coating liquid by removing the basic adsorbent and dispersing metal oxide particles in the obtained solution containing a purified form of the composition; and (iii) forming the undercoat layer by forming a coat of the undercoat-layer-forming coating liquid and drying the coat.

The basic adsorbent contains at least 15% by mass magnesium and has a volume average particle diameter of 10 μm to 500 μm, both inclusive:

(1)

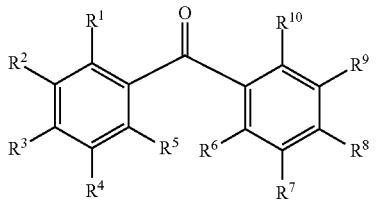

(where $R^1$ to $R^{10}$ each independently represent a hydrogen atom, a halogen atom, a hydroxy group, an alkyl group, an alkoxy group, or an amino group, with at least one of $R^1$ to $R^{10}$ being a hydroxy group).

This method for producing an electrophotographic photosensitive member according to an aspect of the invention allows for efficient removal of a colored impurity from the benzophenone compound represented by the formula (1) used in the undercoat layer and provides the photosensitive member with good sensitivity characteristics.

DESCRIPTION OF THE EMBODIMENTS

An aspect of the invention includes forming an undercoat layer of an electrophotographic photosensitive member by the following (i) to (iii):

(i) dissolving a composition that contains a compound represented by the formula (1) in an organic solvent and purifying the composition by using a basic adsorbent that contains at least 15% by mass magnesium and has a volume average particle diameter of 10 μm to 500 μm, both inclusive;

(ii) after (i), preparing an undercoat-layer-forming coating liquid (i.e., a coating liquid for forming the undercoat layer) by removing the basic adsorbent and dispersing metal oxide particles in the obtained solution containing the purified form of the composition; and (iii) forming the undercoat layer by forming a coat of the undercoat-layer-forming coating liquid and drying the coat.

(1)

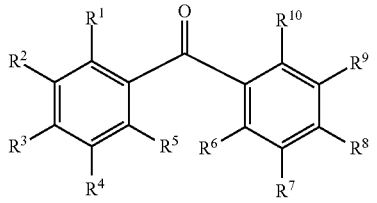

In the formula (1), $R^1$ to $R^{10}$ each independently represent a hydrogen atom, a halogen atom, a hydroxy group, an alkyl group, an alkoxy group, or an amino group. At least one of $R^1$ to $R^{10}$ is a hydroxy group.

(i): Compound of the Formula (1)

The undercoat layer contains a compound represented by the formula (1) along with metal oxide particles. The compound stabilizes electrical properties and reduces image failures in the output images.

Specific examples of compounds represented by the formula (1) include, but are not limited to, the compounds represented by the formulae (1-1) and (1-3) to (1-20).

(1-1)

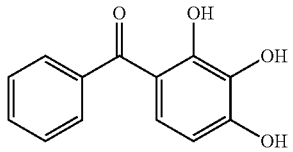

(1-3)

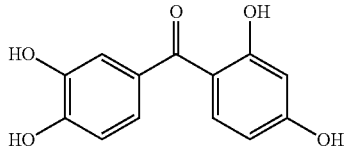

(1-4)

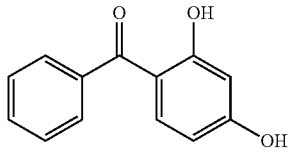

(1-5)

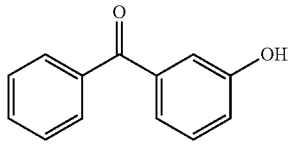

(1-6)

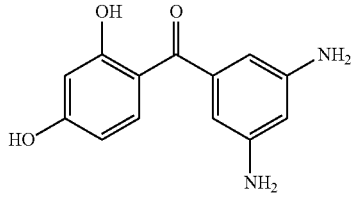

(1-7)

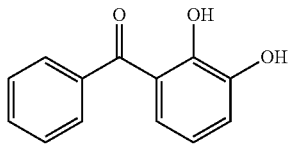

-continued (1-8)

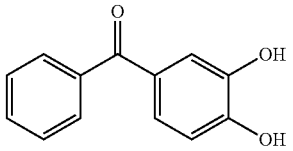

(1-9)

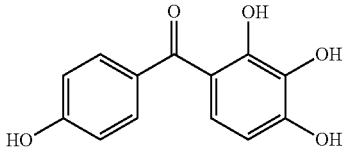

(1-10)

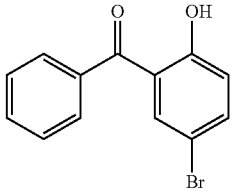

(1-11)

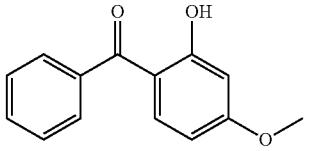

(1-12)

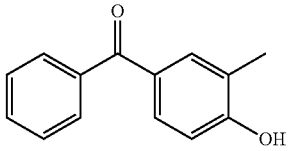

(1-13)

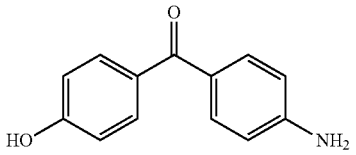

(1-14)

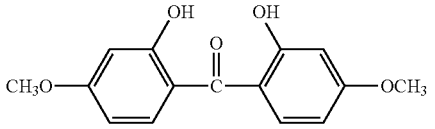

(1-15)

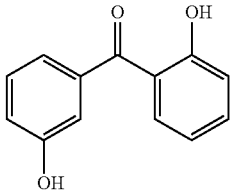

(1-16)

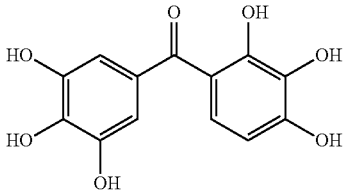

-continued (1-17)

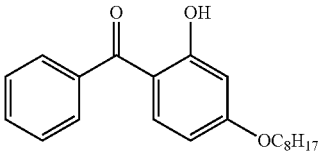

(1-18)

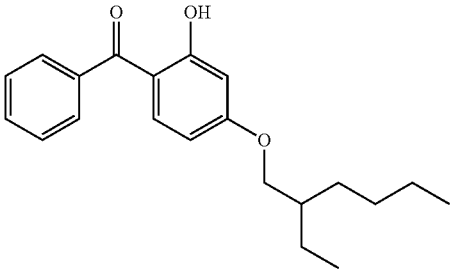

(1-19)

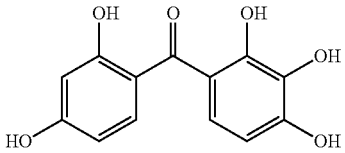

(1-20)

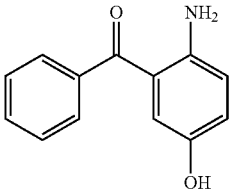

In particular, those compounds represented by the formula (1) in which at least three of substituents $R^1$ to $R^{10}$ are hydroxy groups are preferred in respect of interaction with the metal oxide particles.

In (i), what process is used to purify the composition with the basic adsorbent is not critical as long as the process allows the basic adsorbent come into contact with the composition.

Organic Solvent

The organic solvent in which the composition that contains a compound represented by the formula (1) is dissolved in (i) can be of any kind that dissolves the compound represented by the formula (1). Examples of organic solvents include alcohols, ketones, ethers, esters, aliphatic halogenated hydrocarbons, and aromatic compounds.

Basic Adsorbent

Purifying the composition that contains a compound represented by the formula (1) with a basic adsorbent that contains at least 15% by mass magnesium and has a volume average particle diameter of 10 μm to 500 μm, both inclusive, in (i) makes a colored impurity get adsorbed efficiently from the composition that contains a compound represented by the formula (1) to the adsorbent. The magnesium in the basic adsorbent is typically in the form of magnesium oxide or magnesium hydroxide contained in the adsorbent. The elemental magnesium content must be 15% by mass or more based on the total mass of the adsorbent.

From the viewpoint of more efficient adsorption of a colored impurity, it is preferred that the content of the basic adsorbent be from 50% to 500% by mass relative to the composition that contains a compound represented by the formula (1), more preferably from 50% to 400% by mass.

The chemical composition of the basic adsorbent may contain an oxide or a hydroxide of aluminum, silicon, or other elements in addition to magnesium. Examples of materials that can be used as such a basic adsorbent include magnesium silicate, silica-magnesia, magnesium aluminum oxide, and hydrotalcite. Mixtures of such materials can also be used.

The inventors presume that in (i), the basic adsorbent removes a colored impurity from the composition that contains a compound represented by the formula (1) through the following mechanism. The colored impurity in the composition that contains a compound represented by the formula (1) is presumably an acidic substance. Magnesium oxide and magnesium hydroxide are highly reactive basic substances. It is therefore likely that a basic adsorbent that contains at least 15% by mass magnesium strongly adsorbs acids.

In particular, a compound represented by the composition of the formula (2) (a hydrotalcite compound), which is known as an anion exchanger, absorbs acidic substances with high efficiency.

$$Mg^{2+}_{1-x}Al^{3+}_{x}(OH)_2A^{n-}_{x/n}.mH_2O \quad (2)$$

In the formula (2), $A^{n-}$ is an n-valent anion, $0.20 \le x \le 0.33$, and $0<m$.

Examples of such hydrotalcite compounds include the most common naturally-occurring mineral composition $Mg_6Al_2(OH)_{16}CO_3.4H_2O$ and also include a similar non-stoichiometric compound $Mg_4.6Al_2(OH)_{13}CO_3.3.5H_2O$. As for synthetic hydrotalcites, x in the composition of the formula (2) can vary approximately in the range of 0.20 to 0.33, both inclusive, and such compounds can be used as the basic adsorbent.

A hydrotalcite compound represented by the composition of the formula (2) forms a laminar structure composed of magnesium aluminum hydroxide with an anion (usually $CO_3^-$) and water between layers, and it is known that this structure can be used to initiate an anion-exchange reaction.

For example, when a basic adsorbent comes into contact with HCl, an exchange reaction occurs between the $CO_3$ ions in the basic adsorbent and the Cl ions in the HCl, the HCl in the system is removed, and $H_2O$ and $CO_2$ are released. The inventors presume that an acidic colored impurity in the composition that contains a compound represented by the formula (1) is also adsorbed onto a hydrotalcite compound and efficiently removed from the solvent in a similar way.

The basic adsorbent used in (i) has a volume average particle diameter of 10 μm to 500 μm, both inclusive. The use of a filter in (ii) to remove the basic adsorbent can cause the basic adsorbent to clog up the filter or pass through the filter and get into the undercoat-layer-forming coating liquid when the basic adsorbent has a volume average particle diameter of less than 10 μm.

When the volume average particle diameter exceeds 500 μm, however, the surface area of the basic adsorbent available for contact with the colored impurity is so small that the purification efficiency is affected. The content of the basic adsorbent can be determined in accordance with the effectiveness of the basic adsorbent and the quantity of the colored impurity to be removed.

The basic adsorbent used in (i) can also be a mixture of two or more basic adsorbents with different characteristics, e.g., different chemical compositions or particle diameters, as long as each contains at least 15% by mass magnesium and has a volume average particle diameter of 10 μm to 500 μm, both inclusive.

It is also possible to use another adsorbent simultaneously with or before or after the "basic adsorbent that contains at least 15% by mass magnesium and has a volume average particle diameter of 10 μm to 500 μm, both inclusive." Examples of such adsorbents include molecular sieves (synthetic zeolite), silica gel, activated alumina, activated clay, and silica-magnesia preparations. In particular, the use of a molecular sieve allows for efficient removal of water released during purification with the adsorbent when the adsorbent contains water.

In (ii), the adsorbent can be removed by appropriate common techniques such as filtration, centrifugation, and separation of the supernatant.

Metal Oxide Particles

The metal oxide particles can be titanium oxide particles, zinc oxide particles, tin oxide particles, zirconium oxide particles, or aluminum oxide particles, for example. From the viewpoint of dispersibility in the coating liquid and the electrical properties of the electrophotographic photosensitive member, it is preferred that such metal oxide particles have their surface treated. In particular, surface-treated zinc oxide particles are preferred in respect of electrical properties. The metal oxide particles used in certain aspects of the invention can be a mixture of two or more kinds of metal oxide particles with different characteristics, e.g., different metal oxide species, surface treatments, or specific surface areas.

In (ii), it is preferred that the content of the purified form of the composition that contains a compound represented by the formula (1) be from 0.05% to 4% by mass relative to the metal oxide particles. This is preferred because the stability of the coating liquid is sufficient when the content of the purified composition is in this range.

The undercoat-layer-forming coating liquid prepared in (ii) preferably contains 10% to 50% by mass, both inclusive, organic polymer relative to the metal oxide particles. Examples of organic polymers for the undercoat layer include acrylic polymers, allyl polymers, alkyd polymers, ethyl cellulose polymers, ethylene-acrylic acid copolymers, epoxy polymers, casein polymers, silicone polymers, gelatin polymers, phenolic polymers, butyral polymers, polyacrylate, polyacetal, polyamide-imides, polyamides, polyallyl ethers, polyimides, polyurethane, polyesters, polyethylene, polycarbonate, polystyrene, polysulfone, polyvinyl alcohol, polybutadiene, and polypropylene. One or a mixture of two or more such polymers can be used. Polyurethane is preferred in particular.

In (ii), the undercoat-layer-forming coating liquid can be prepared by subjecting the solution that contains the purified form of the composition that contains a compound represented by the formula (1) and the metal oxide particles, an organic polymer, and a solvent together to a dispersion process. It is also possible to first subject the solution that contains the purified form of the composition that contains a compound represented by the formula (1) and the metal oxide particles to a dispersion process, add a solution that contains an organic polymer, and then subject the resulting mixture to a dispersion process. Examples of dispersion techniques include those based on the use of a homogenizer, a paint shaker, ultrasonic dispersion equipment, a ball mill, a sand mill, a roll mill, a vibration mill, an attritor, or high-speed liquid jet dispersion equipment.

Furthermore, the coating liquid prepared in (ii) may optionally contain fine particles of an organic polymer or a leveling agent for purposes such as to adjust the surface roughness and permeability of the undercoat layer or reduce cracks in the undercoat layer. Examples of organic polymer particles that can be used include hydrophobic organic polymer particles, e.g., silicone particles, and hydrophilic organic polymer particles, e.g., cross-linked polymethylmethacrylate (PMMA) particles.

Step (iii)

Examples of coating techniques that can be used in (iii) to form a coat of the undercoat-layer-forming coating liquid include dip coating, spray coating, spinner coating, bead coating, blade coating, and beam coating. The coat can be dried by heating or/and air-blowing.

The thickness of the undercoat layer is preferably approximately in the range of 0.5 to 30 μm, in particular 1 to 25 μm.

The following describes an electrophotographic photosensitive member produced by a method according to an aspect of the invention. An electrophotographic photosensitive member produced in accordance with an aspect of the invention has a support (an electroconductive support), an undercoat layer on the support, and a photosensitive layer on the undercoat layer. The photosensitive layer can be a single-layer photosensitive layer, which contains a charge generation material and a charge transport material in a single layer, or a separate-function (multilayer) photosensitive layer, which has separate functional layers including a charge transport layer that contains a charge transport material and a charge generation layer that contains a charge generation material.

From the viewpoint of electrophotographic properties, a separate-function (multilayer) photosensitive layer is preferred, more preferably one in which a charge generation layer and a charge transport layer are stacked in this order from the support side. A protective layer may be optionally disposed on the photosensitive layer.

The support is preferably an electroconductive support. Examples of electroconductive supports that can be used include supports made of metals (alloys) such as aluminum, aluminum alloys, stainless steel, and nickel. It is also possible to use a metal or plastic support that has a cover layer made of aluminum, an aluminum alloy, indium oxide-tin oxide, or a similar metal or alloy formed by vacuum deposition. Other examples include a plastic or paper support impregnated with carbon black, tin oxide particles, titanium oxide particles, silver particles, or a similar material together with a suitable polymeric binder and a plastic support that contains an electroconductive polymeric binder.

The support can have a cylindrical or belt-like shape, for example. Preferably, the support has a cylindrical shape. The support may have its surface cut, roughened, or anodized to reduce interference fringes that occur upon scattering of laser light.

Between the support and the undercoat layer, an electroconductive layer may be disposed in order to reduce interference fringes that occur upon scattering of laser light or to cover scratches on the support. Such an electroconductive layer can be formed by dispersing carbon black and electroconductive particles in a polymeric binder. The thickness of such an electroconductive layer is preferably in the range of 5 to 40 μm, in particular 10 to 30 μm.

Between the support or an electroconductive layer and the photosensitive layer (a charge generation layer and a charge transport layer), the undercoat layer is formed by a method according to an aspect of the invention. On the undercoat layer, the photosensitive layer is disposed.

Examples of charge generation materials include azo pigments, phthalocyanine pigments, indigo pigments, perylene pigments, polycyclic quinone pigments, squarylium dyes, pyrylium salts and thiapyrylium salts, triphenylmethane dyes, quinacridone pigments, azulenium salt pigments, cyanine pigments, anthanthrone pigments, pyranthrone pigments, xanthene dyes, quinonimine dyes, and styryl dyes.

Phthalocyanine pigments and azo pigments are preferred from the viewpoint of sensitivity, in particular phthalocyanine pigments. Within phthalocyanine compounds, oxytitanium phthalocyanine, chlorogallium phthalocyanine, and hydroxygallium phthalocyanine generate charge with particularly high efficiency. One or two or more of such charge generation materials can be used.

When a multilayer photosensitive layer is used, examples of polymeric binders used to form the charge generation layer include acrylic polymers, allyl polymers, alkyd polymers, epoxy polymers, diallyl phthalate polymers, styrene-butadiene copolymers, butyral polymers, benzal polymers, polyacrylate, polyacetal, polyamide-imides, polyamides, polyallyl ethers, polyarylate, polyimides, polyurethane, polyesters, polyethylene, polycarbonate, polystyrene, polysulfone, polyvinyl acetal, polybutadiene, polypropylene, methacrylic polymers, urea polymers, vinyl chloride-vinyl acetate copolymers, vinyl acetate polymers, and vinyl chloride polymers. Butyral polymers are preferred in particular. One or two or more of such polymers can be used alone or in the form of a mixture or a copolymer.

The charge generation layer can be produced by forming a coat of a charge-generation-layer-forming coating liquid (i.e., a coating liquid for forming the charge generation layer) and drying the coat. The charge-generation-layer-forming coating liquid can be obtained by dispersing a charge generation material and a polymeric binder in a solvent. Examples of dispersion techniques include those based on the use of a homogenizer, ultrasonic dispersion equipment, a paint shaker, a ball mill, a sand mill, a roll mill, a vibration mill, an attritor, or high-speed liquid jet dispersion equipment. It is preferred that the ratio between the charge generation material and the polymeric binder be in the range of 0.3:1 to 10:1 on a mass basis.

Examples of solvents that can be used in such a charge-generation-layer-forming coating liquid include alcohols, sulfoxides, ketones, ethers, esters, aliphatic halogenated hydrocarbons, and aromatic compounds.

The thickness of the charge generation layer is preferably 5 μm or less, in particular from 0.1 μm to 2 μm. The charge generation layer may optionally contain sensitizers, antioxidants, ultraviolet absorbers, and plasticizers.

Examples of charge transport materials include triarylamine compounds, hydrazone compounds, styryl compounds, stilbene compounds, and butadiene compounds. In particular, triarylamine compounds are preferred because of high charge mobility.

When a multilayer photosensitive layer is used, examples of polymeric binders used in the charge transport layer include acrylic polymers, acrylonitrile polymers, allyl polymers, alkyd polymers, epoxy polymers, silicone polymers, phenolic polymers, phenoxy polymers, polyacrylamide, polyamide-imides, polyamides, polyallyl ethers, polyarylate, polyimides, polyurethane, polyesters, polyethylene, polycarbonate, polysulfone, polyphenylene oxide, polybutadiene, polypropylene, and methacrylic polymers. Polyarylate and polycarbonate are preferred in particular. One or two or more of such polymers can be used alone or in the form of a mixture or a copolymer.

The charge transport layer can be produced by forming a coat of a charge-transport-layer-forming coating liquid (i.e., a coating liquid for forming the charge transport layer) and drying the coat. The charge-transport-layer-forming coating liquid can be obtained by dissolving a charge transport material and a polymeric binder in a solvent. It is preferred that the ratio between the charge transport material and the polymeric binder be in the range of 0.3:1 to 10:1 on a mass basis. From the viewpoint of reducing cracks, it is preferred that the drying temperature be from 60° C. to 150° C., in particular from 80° C. to 120° C. The duration of drying is preferably from 10 minutes to 60 minutes.

Examples of solvents that can be used in such a charge-transport-layer-forming coating liquid include alcohols such as propanol and butanol (in particular, alcohols that contain three or more carbon atoms), aromatic hydrocarbons such as anisole, toluene, xylene, and chlorobenzene, and methylcyclohexane and ethylcyclohexane.

When multiple charge transport layers are stacked, the charge transport layer on the side of the surface of the electrophotographic photosensitive member can be a layer obtained by polymerizing and/or cross-linking a charge transport material that has a chain-polymerizable functional group in order that the mechanical strength of the electrophotographic photosensitive member can be enhanced. Examples of chain-polymerizable functional groups include acryl, alkoxysilyl, and epoxy groups. The polymerization and/or cross-linking of a charge transport material that has a chain-polymerizable functional group can be conducted by means of heat, light, or radiation (e.g., electron radiation).

When the electrophotographic photosensitive member has only one charge transport layer (a single-layer charge transport layer), the thickness of the charge transport layer is preferably from 5 μm to 40 μm, in particular from 8 μm to 30 μm.

When multiple charge transport layers are stacked, the thickness of the charge transport layer on the side of the support of the electrophotographic photosensitive member is preferably from 5 μm to 30 μm, whereas the thickness of the charge transport layer on the side of the surface of the electrophotographic photosensitive member is preferably from 1 μm to 10 μm. The charge transport layer may optionally contain additives such as antioxidants, ultraviolet absorbers, and plasticizers.

A protective layer may be disposed on the photosensitive layer to protect the photosensitive layer. Such a protective layer can be formed by applying a protective-layer-forming coating liquid (i.e., a coating liquid for forming the protective layer) and drying the obtained coating. The protective-layer-forming coating liquid can be obtained by dissolving a polymeric binder, such as those mentioned above, in a solvent. Such a protective layer can also be formed by curing and/or drying a coat of a protective-layer-forming coating liquid obtained by dissolving a polymerizable monomer or oligomer in a solvent. Such a coat can be cured by means of light, heat, or radiation (e.g., electron radiation).

The thickness of such a protective layer is preferably from 0.5 μm to 10 μm, in particular from 1 μm to 7 μm. Such a protective layer may optionally contain additives such as electroconductive particles.

The above coating liquids can be applied by coating techniques such as dip coating, spray coating, spinner coating, roller coating, wire-bar coating, and blade coating.

The topmost layer (surface layer) of the electrophotographic photosensitive member may contain lubricants such as silicone oil, wax, polytetrafluoroethylene particles, silica particles, alumina particles, and boron nitride.

EXAMPLES

The following describes an aspect of the invention in more detail by providing specific examples. It should be noted that no aspect of the invention is limited to these examples. In the following examples, the term "parts" refers to "parts by mass," and "%" refers to"% by mass."

Example 1

Production of Electrophotographic Photosensitive Member A-1

One hundred parts of 2,3,4-trihydroxybenzophenone (Wako Pure Chemical Industries), a composition that contains the compound represented by the formula (1-1), was mixed and stirred in 700 parts of methyl ethyl ketone until dissolution. While the mixture was stirred, 150 parts of KYOWAAD 500SH basic adsorbent (Kyowa Chemical Industries, $Mg_6Al_2(OH)_{16}CO_3.4H_2O$; MgO content, 38.0% (Mg content, 22.9%); volume average particle diameter, approx. 49 μm) and 75 parts of molecular sieve 5A (Kishida Chemical, 1/16" pellets) were added, and the resulting mixture was stirred for 30 minutes. The basic adsorbent and the molecular sieve were then removed by suction filtration, yielding a solution of purified 2,3,4-trihydroxybenzophenone (10% solids dissolved in methyl ethyl ketone).

Then 100 parts of zinc oxide particles (specific surface area, 19 $m^2/g$; powder resistivity, $4.7\times10^6$ Ω·cm) were mixed and stirred in 500 parts of toluene, 0.8 parts of a silane coupling agent (compound name, N-2-(aminoethyl)-3-aminopropyl methyl dimethoxy silane; trade name, KBM602; Shin-Etsu Chemical) was added, and the resulting mixture was stirred for 6 hours. After toluene was distilled off under reduced pressure, the residue was dried by heating at 140° C. for 6 hours, yielding surface-treated zinc oxide particles.

Then 15 parts of a butyral polymer (trade name, BM-1; Sekisui Chemical) and 15 parts of a blocked isocyanate (trade name, Sumidur 3175; Sumika Bayer Urethane) were dissolved in a mixture of 68 parts of methyl ethyl ketone and 72 parts of 1-butanol. To the resulting solution, 4.05 parts of the solution of purified 2,3,4-trihydroxybenzophenone (solid content, 10% parts) and 81 parts of the surface-treated zinc oxide particles were added.

The added components were dispersed in an atmosphere at 23±3° C. for 3 hours using a sand mill with 0.8-mm glass beads. The resulting dispersion was stirred with 0.01 parts of silicone oil (trade name, SH28PA; Dow Corning Toray) and 5.6 parts of polymethylmethacrylate (PMMA) particles (trade name, TECHPOLYMER SSX-103; Sekisui Plastics; average primary particle diameter, 3.11 μm), yielding an undercoat-layer-forming coating liquid.

The undercoat-layer-forming coating liquid was applied to an aluminum cylinder (an electroconductive support) 30 mm in diameter and 370 mm in length by dip coating to form a coat. The coat was dried at 160° C. for 40 minutes to form an undercoat layer with a thickness of 18 μm.

Then crystalline hydroxygallium phthalocyanine (a charge generation material) was prepared that had diffraction peaks at Bragg angles, 2θ±0.2°, of 7.4° and 28.1° in the CuKα characteristic X-ray diffraction pattern. Four parts of the crystalline hydroxygallium phthalocyanine and 0.04 parts of the compound represented by the formula (A) were added to a solution of 2 parts of a butyral polymer (trade name, BX-1; Sekisui Chemical) in 100 parts of cyclohexanone.

(A)

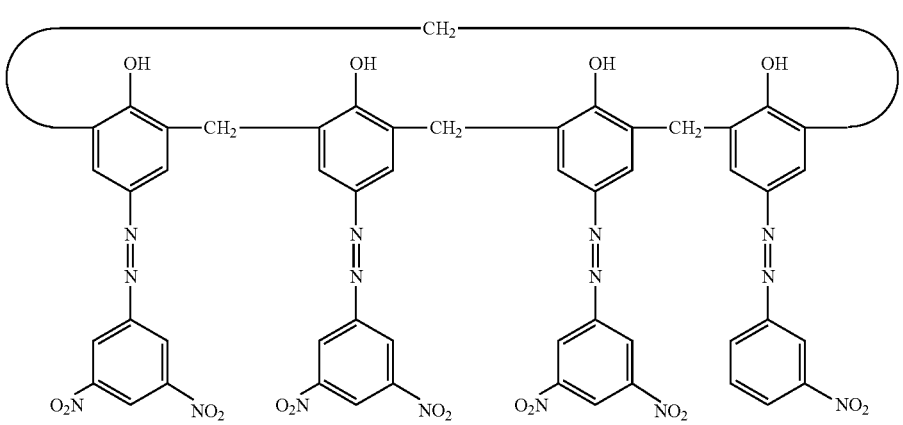

After 1-hour dispersion in an atmosphere at 23±3° C. in a sand mill with 1-mm glass beads, 100 parts of ethyl acetate was added, yielding a charge-generation-layer-forming coating liquid. The charge-generation-layer-forming coating liquid was applied over the undercoat layer by dip coating to form a coat. The coat was dried at 90° C. for 10 minutes to form a charge generation layer with a thickness of 0.19 μm.

Then a charge-transport-layer-forming coating liquid was prepared by dissolving the materials listed in Table 1 in a mixture of 600 parts of chlorobenzene and 200 parts of dimethoxymethane. The charge-transport-layer-forming coating liquid was applied over the charge generation layer by dip coating to form a coat. The coat was dried at 100° C. for 30 minutes to form a charge transport layer with a thickness of 21 μm.

TABLE 1

| | |
|---|---|
| Compound represented by the structural formula (B) (charge transport material) | 60 parts |
| Compound represented by the structural formula (C) (charge transport material) | 30 parts |
| Compound represented by the structural formula (D) | 10 parts |
| Polycarbonate (trade name, lupilon Z400; Mitsubishi Engineering-Plastics, a bisphenol-Z type polycarbonate) | 100 parts |
| Polycarbonate having the structural unit represented by the structural formula (E) (viscosity average molecular weight Mv: 20000) | 0.02 parts |

TABLE 1-continued

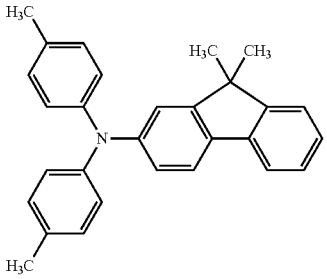

(B)

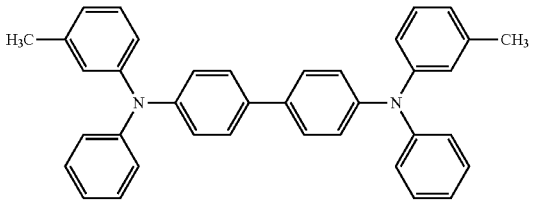

(C)

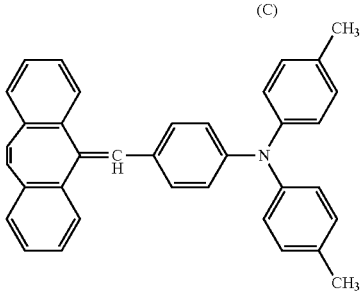

(D)

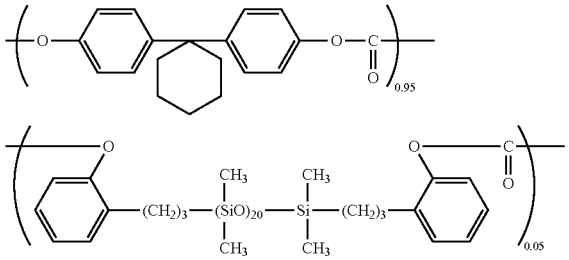

(E)

(In the formula (E), the numbers 0.95 and 0.05 represent the proportions of the two structural units in the copolymer.)

Then the following procedures were followed to prepare a protective-layer-forming coating liquid.

First, 1.5 parts of a fluorinated polymer (trade name, GF-300; Toagosei Co., Ltd.) was dissolved in a mixture of 45 parts of 1,1,2,2,3,3,4-heptafluorocyclopentane (trade name, ZEORORA-H; ZEON Corporation) and 45 parts of 1-propanol. Thirty parts of a polytetrafluoroethylene powder (trade name, Lubron L-2; Daikin Industries) was added, and the resulting liquid was allowed to pass through a high-shear fluid processor (trade name, Microfluidizer M-110EH; Microfluidics (US)), yielding a dispersion.

Then 70 parts of the hole transport compound represented by the formula (F), 30 parts of 1,1,2,2,3,3,4-heptafluorocyclopentane, and 30 parts of 1-propanol were added to the dispersion, and the resulting liquid was filtrated through a POLYFLON filter (trade name, PF-040; Advantec Toyo Kaisha). In this way, a protective-layer-forming coating liquid was prepared.

(F)

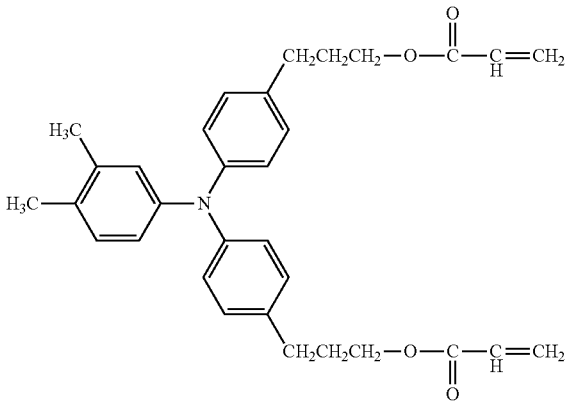

The protective-layer-forming coating liquid was applied over the charge transport layer by dip coating to form a coat. The coat was dried at 50° C. for 5 minutes. The dried coating was irradiated with electron radiation in a nitrogen atmosphere for 1.6 seconds with the acceleration voltage at 60 kV and the absorbed dose at 8000 Gy. The coating was then heated in a nitrogen atmosphere for 1 minute under such conditions that the temperature of the coating should be 130° C. The oxygen concentration during the period from the irradiation with electron radiation to the 1-minute heating was 20 ppm.

Then the coating was heated in the air for 1 hour under such conditions that the temperature of the coating should be 110° C., forming a protective layer with a thickness of 5 μm. In this way, an electrophotographic photosensitive member A-1 was produced that had an undercoat layer, a charge generation layer, a charge transport layer, and a protective layer stacked on a support.

Production of Electrophotographic Photosensitive Member C-1

A solution of 2,3,4-trihydroxybenzophenone (Wako Pure Chemical Industries) in methyl ethyl ketone, 10% solids, was prepared without the purification mentioned in the production of the electrophotographic photosensitive member A-1.

An electrophotographic photosensitive member C-1 was produced in the same way as in the production of the electrophotographic photosensitive member A-1 except that 40.5 parts of a solution of crude 2,3,4-trihydroxybenzophenone was used.

Example 2

An electrophotographic photosensitive member A-2 was produced in the same way as in the production of the electrophotographic photosensitive member A-1 in Example 1 except that molecular sieve 5A was not used.

Example 3

An electrophotographic photosensitive member A-3 was produced in the same way as in the production of the electrophotographic photosensitive member A-1 in Example 1 except that the quantities of KYOWAAD 500SH basic adsorbent and the molecular sieve were 50 parts and 50 parts, respectively.

Example 4

An electrophotographic photosensitive member A-4 was produced in the same way as in the production of the electrophotographic photosensitive member A-1 in Example 1 except that the quantities of KYOWAAD 500SH basic adsorbent and the molecular sieve were 400 parts and 100 parts, respectively.

Example 5

An electrophotographic photosensitive member A-5 was produced in the same way as in Example 2 except that 200 parts of KYOWAAD 500SN basic adsorbent (Kyowa Chemical Industries, $Mg_6Al_2(OH)_{16}CO_3.4H_2O$; MgO content, 38.7% (Mg content, 23.3%); volume average particle diameter, approx. 300 μm) was used instead of the 150 parts of KYOWAAD 500SH basic adsorbent.

Example 6

An electrophotographic photosensitive member A-6 was produced in the same way as in Example 2 except that 100 parts of KYOWAAD 500PL basic adsorbent (Kyowa Chemical Industries, $Mg_6Al_2(OH)_{16}CO_3.4H_2O$; MgO content, 38.9% (Mg content, 23.5%); volume average particle diameter, approx. 14 μm) was used instead of the 150 parts of KYOWAAD 500SH basic adsorbent.

Example 7

An electrophotographic photosensitive member A-7 was produced in the same way as in Example 2 except that KYOWAAD 10005 basic adsorbent (Kyowa Chemical Industries, $Mg_4.5Al_2(OH)_{13}CO_3.3.5H_2O$; MgO content, 35.1% (Mg content, 21.2%); volume average particle diameter, approx. 52 μm) was used instead of KYOWAAD 500SH basic adsorbent.

Example 8

Electrophotographic photosensitive members A-8 and C-2 were produced in the same way as in Example 1 except that 2,4-dihydroxybenzophenone (Wako Pure Chemical Industries) and KW-2000 basic adsorbent (Kyowa Chemical Industries, a solid solution of magnesium and aluminum, $Mg_{0.7}Al_{0.3}O_{1.15}$; MgO content, 58.4% (Mg content, 35.2%); volume average particle diameter, approx. 70 μm) were used instead of 2,3,4-trihydroxybenzophenone and KYOWAAD 500SH basic adsorbent, respectively, and the molecular sieve was not used.

Example 9

An electrophotographic photosensitive member A-9 was produced in the same way as in the production of the electrophotographic photosensitive member A-8 in Example 8 except that MIZUKALIFE F-1G basic adsorbent (Mizusawa Industrial Chemicals, a silica-magnesia preparation; MgO content, 29.0% (Mg content, 17.5%); volume average particle diameter, 150 μm) was used instead of KW-2000 basic adsorbent.

Example 10

Electrophotographic photosensitive members A-10 and C-3 were produced in the same way as in Example 1 except that 2,3,4,4-tetrahydroxybenzophenone (Wako Pure Chemical Industries) was used instead of 2,3,4-trihydroxybenzophenone and the molecular sieve was not used.

Example 11

An electrophotographic photosensitive member A-11 was produced in the same way as in Example 2 except that 2,4-dihydroxybenzophenone (Wako Pure Chemical Industries) was used instead of 2,3,4-trihydroxybenzophenone.

Example 12

Electrophotographic photosensitive members A-12 and C-4 were produced in the same way as in Example 1 except that 3,4-dihydroxybenzophenone (Wako Pure Chemical Industries) was used instead of 2,3,4-trihydroxybenzophenone and the molecular sieve was not used.

Example 13

Electrophotographic photosensitive members A-13 and C-5 were produced in the same way as in Example 1 except that 2-hydroxy-4-methoxybenzophenone (Wako Pure Chemical Industries) was used instead of 2,3,4-trihydroxybenzophenone and the molecular sieve was not used.

Example 14

Electrophotographic photosensitive members A-14 and C-6 were produced in the same way as in Example 1 except that 2-hydroxy-4-octylbenzophenone (Wako Pure Chemical Industries) was used instead of 2,3,4-trihydroxybenzophenone and the molecular sieve was not used.

Comparative Example 1

An electrophotographic photosensitive member B-1 was produced in the same way as in Example 2 except that molecular sieve 5A (Kishida Chemical, 1/16" pellets) was used instead of KYOWAAD 500SH basic adsorbent.

Comparative Example 2

An electrophotographic photosensitive member B-2 was produced in the same way as in Example 2 except that Chromatorex BW200 (Fuji Silysia, silica gel; average particle diameter, 70 μm) was used instead of KYOWAAD 500SH basic adsorbent.

Comparative Example 3

An electrophotographic photosensitive member B-3 was produced in the same way as in Example 2 except that KCG-30 (Sumika Alchem, activated alumina; average particle diameter, 40 to 50 μm) was used instead of KYOWAAD 500SH basic adsorbent.

Comparative Example 4

An electrophotographic photosensitive member B-4 was produced in the same way as in Example 2 except that Nikkagel M-30 (Toshin Chemicals, a synthesized silica-magnesia adsorbent; MgO content, 13.4% (Mg content, 8.1%); average particle diameter, 70 μm) was used instead of KYOWAAD 500SH basic adsorbent.

Comparative Example 5

An electrophotographic photosensitive member B-5 was produced in the same way as in Example 2 except that Nikkanite G-36 (Toshin Chemicals, activated clay; MgO content, 1% to 3% (Mg content, <2%); average particle diameter, 300 to 500 μm) was used instead of KYOWAAD 500SH basic adsorbent.

Comparative Example 6

Electrophotographic photosensitive members B-6 and C-7 were produced in the same way as in Example 1 except that benzophenone (Wako Pure Chemical Industries) was used instead of 2,3,4-trihydroxybenzophenone and the molecular sieve was not used.

Comparative Example 7

Electrophotographic photosensitive members B-7 and C-8 were produced in the same way as in Example 1 except that alizarin (Wako Pure Chemical Industries) was used instead of 2,3,4-trihydroxybenzophenone and the molecular sieve was not used.

Evaluation of the Sensitivity of Electrophotographic Photosensitive Members

Canon imageRUNNER iR-ADV C9075 PRO copier was used as an electrophotographic apparatus for evaluation after some modifications. The electrophotographic photosensitive members A-1 and C-1 and the copier were left at a temperature of 23° C. and a humidity of 50% RH for 3 days, and then the electrophotographic photosensitive member C-1 was installed in the copier. The laser intensity and the applied voltage were adjusted so that the initial light area and dark area potentials would be −200 V and −750 V, respectively.

Then the electrophotographic photosensitive member A-1 was installed in the copier, and the applied voltage was adjusted so that the initial dark area potential would be −750V. With the set level of laser intensity maintained, the light area potential was measured and determined to be −175V. The difference in sensitivity is defined as −25 V in this case.

In the same way, the difference in sensitivity was measured between the electrophotographic photosensitive members A-2 to A-14 and B-1 to B-7 and the comparative electrophotographic photosensitive members given in Table 2. The evaluation results are summarized in Table 2.

TABLE 2

| | Photosensitive member | Compound represented by the formula (1) in the composition | Adsorbent | |
|---|---|---|---|---|
| | | | Adsorbent | Main ingredient |
| Example 1 | A-1 | Formula (1-1) | 500SH | $Mg_6Al_2(OH)_{16}CO_3 \cdot 4H_2O$ |
| Example 2 | A-2 | | | |
| Example 3 | A-3 | | | |
| Example 4 | A-4 | | | |
| Example 5 | A-5 | | 500SN | $Mg_6Al_2(OH)_{16}CO_3 \cdot 4H_2O$ |
| Example 6 | A-6 | | 500PL | $Mg_6Al_2(OH)_{16}CO_3 \cdot 4H_2O$ |
| Example 7 | A-7 | | 1000S | $Mg_{4.5}Al_2(OH)_{13}CO_3 \cdot 3.5H_2O$ |
| Example 8 | A-8 | Formula (1-4) | KW-2000 | $Mg_{0.7}Al_{0.3}O_{1.15}$ |
| Example 9 | A-9 | | F-1G | $SiO_2 + MgO + H_2O$ |
| Example 10 | A-10 | Formula (1-9) | 500SH | $Mg_6Al_2(OH)_{16}CO_3 \cdot 4H_2O$ |
| Example 11 | A-11 | Formula (1-4) | | |
| Example 12 | A-12 | Formula (1-8) | | |
| Example 13 | A-13 | Formula (1-11) | | |
| Example 14 | A-14 | Formula (1-17) | | |
| Comparative Example 1 | B-1 | Formula (1-1) | 5A | Molecular sieve ($CaO + Na_2O + Al_2O_3 + SiO_2$) |
| Comparative Example 2 | B-2 | | BW200 | SiO2 |
| Comparative Example 3 | B-3 | | KCG-30 | $Al_2O_3$ |
| Comparative Example 4 | B-4 | | M-30 | SiO2 + MgO + Ig.Loss |
| Comparative Example 5 | B-5 | | G-36 | SiO2 + $Al_2O_3$ + Ig.Loss |
| Comparative Example 6 | B-6 | Benzophenone instead of a compound represented by the formula (1) | 500SH | $Mg_6Al_2(OH)_{16}CO_3 \cdot 4H_2O$ |
| Comparative Example 7 | B-7 | Alizarin instead of a compound represented by the formula (1) | | |

| | Adsorbent | | | Molecular | Difference in sensitivity | |
|---|---|---|---|---|---|---|
| | Mg (%) | Particle diameter (μm) | Content (parts) | sieve Content (parts) | Comparative photosensitive member | Difference in sensitivity (V) |
| Example 1 | 22.9 | 49 | 150 | 75 | C-1 | −25 |
| Example 2 | | | 150 | — | | −24 |
| Example 3 | | | 50 | 50 | | −16 |
| Example 4 | | | 400 | 200 | | −26 |
| Example 5 | 23.3 | 300 | 200 | — | | −20 |
| Example 6 | 23.5 | 14 | 100 | — | | −21 |
| Example 7 | 21.2 | 52 | 150 | — | | −19 |
| Example 8 | 35.2 | 70 | 150 | — | C-2 | −13 |
| Example 9 | 17.5 | 150 | 150 | — | | −10 |
| Example 10 | 22.9 | 49 | 150 | — | C-3 | −25 |

TABLE 2-continued

| | | | | | | |
|---|---|---|---|---|---|---|
| Example 11 | | | | — | C-2 | −15 |
| Example 12 | | | | — | C-4 | −13 |
| Example 13 | | | | — | C-5 | −14 |
| Example 14 | | | | — | C-6 | −13 |
| Comparative Example 1 | 0 | Pellets | 150 | — | C-1 | — |
| Comparative Example 2 | 0 | 70 | 150 | — | | +3 |
| Comparative Example 3 | 0 | 40-50 | 150 | — | | −2 |
| Comparative Example 4 | 8.1 | 70 | 150 | — | | +4 |
| Comparative Example 5 | <2 | 300-500 | 150 | — | | +5 |
| Comparative Example 6 | 22.9 | 49 | 150 | — | C-7 | −1 |
| Comparative Example 7 | | 49 | 150 | — | C-8 | 0 |

As shown in Table 2, the sensitivity characteristics of the electrophotographic photosensitive members were better with undercoat layers formed by the methods of Examples than with undercoat layers formed by the methods of Comparative Examples.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-076490, filed Apr. 1, 2013, which is hereby incorporated by reference herein in its entirety.

What is claimed is:

1. A method for producing an electrophotographic photosensitive member comprising: a support, an undercoat layer on the support, and a photosensitive layer on the undercoat layer, the method comprising the steps of:

(A) forming the undercoat layer on the support, and (B) forming the photosensitive layer on the undercoat layer, wherein the step (A) includes the following steps (i), (ii), (iii) and (iv):

(i) providing a composition containing a compound represented by the formula (1) and an organic solvent dissolving the compound:

(1)

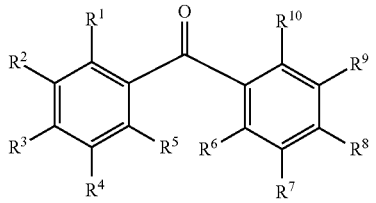

where $R^1$ to $R^{10}$ each independently represent a hydrogen atom, a halogen atom, a hydroxy group, an alkyl group, an alkoxy group, or an amino group, with at least one of $R^1$ to $R^{10}$ being a hydroxy group;

(ii) purifying the composition by bringing the composition into contact with a basic adsorbent and adsorbing an impurity in the composition to the basic adsorbent, to obtain a purified form of the composition;

(iii) preparing an undercoat-layer-forming coating liquid by dispersing metal oxide particles to the purified form of the composition resulting from the step (ii); and (iv) forming the undercoat layer by forming a coat of the undercoat-layer-forming coating liquid and drying the coat, and wherein the basic adsorbent contains at least 15% by mass magnesium and has a volume average particle diameter of 10 μm to 500 μm, both inclusive.

2. The method for producing the electrophotographic photosensitive member according to claim 1, wherein the basic adsorbent is a compound represented by the composition of the formula (2):

$$Mg^{2+}_{1-x}Al^{3+}_{x}(OH)_2A^{n-}_{x/n}.mMH_2O \quad (2)$$

where $A^{n-}$ is an n-valent anion, $0.20 \leq x \leq 0.33$, and $0<m$.

3. The method for producing the electrophotographic photosensitive member according to claim 1, wherein in the formula (1), at least three of $R^1$ to $R^{10}$ are hydroxy groups.

4. The method for producing the electrophotographic photosensitive member according to claim 1, wherein:

in (ii), a molecular sieve is used as another adsorbent simultaneously with or before or after using the basic adsorbent; and the step (ii) further includes removing the molecular sieve.

5. The method for producing the electrophotographic photosensitive member according to claim 1, wherein in (ii), a content of the basic adsorbent is from 50% to 500% by mass relative to the composition.

6. The method for producing the electrophotographic photosensitive member according to claim 1, wherein the metal oxide particles are zinc oxide particles.

7. The method for producing the electrophotographic photosensitive member according to claim 1, wherein in (iii), a content of the purified form of the composition containing the compound represented by the formula (1) is from 0.05% to 4% by mass relative to the metal oxide particles.

* * * * *